United States Patent [19]

Homolka

[11] Patent Number: 5,052,946

[45] Date of Patent: Oct. 1, 1991

[54] PLUG CONNECTOR FOR HIGH-VOLTAGE COAXIAL CABLES

[75] Inventor: Jürgen Homolka, Stuttgart, Fed. Rep. of Germany

[73] Assignee: Haug GmbH & Co. KG, Leinfelden-Echterdingen, Fed. Rep. of Germany

[21] Appl. No.: 602,755

[22] Filed: Oct. 24, 1990

[51] Int. Cl.[5] ..... H01R 17/18

[52] U.S. Cl. ..... 439/584; 439/427

[58] Field of Search ..... 439/425, 427, 663, 578–585, 439/675, 750, 593, 426, 805

[56] References Cited

U.S. PATENT DOCUMENTS

| | | | |
|---|---|---|---|
| 2,839,595 | 6/1958 | Felts et al. | 439/427 |
| 3,170,748 | 2/1965 | Van Horssen | 439/584 |
| 3,634,815 | 1/1971 | Stevens | 439/583 |
| 3,810,074 | 5/1974 | Brandenburg, Jr. | 439/427 |
| 4,494,816 | 1/1985 | Tamburro | 339/177 R |
| 4,761,146 | 8/1988 | Sohoel | 439/584 |

FOREIGN PATENT DOCUMENTS 7903554 9/1980 Fed. Rep. of Germany .

*Primary Examiner*—David L. Pirlot
*Attorney, Agent, or Firm*—Shenier & O'Connor

[57] ABSTRACT

A plug connector for high-voltage coaxial cables. The cable comprises an inner conductor, an inner insulation, a metallic screen netting and an insulation, outer sheath. The plug connector comprises a plug-in contact element connected to the inner conductor, a metal sleeve connected to the screen netting and an insulating housing connecting the contact element to the metal sleeve. A sealing sleeve made of elastic, electrically insulating material is pushed onto the inner insulation of the cable. The contat element penetrates into the inner conductor such that the inner insulation arranges itself sealingly againsts the inner surface of the sealing sleeve. Owing to the connection of the insulating housing to the metal sleeve, the sealing sleeve undergoes such deformation that it arranges itself sealingly with its outer surface against the inner surface of the insulating housing.

1 Claim, 2 Drawing Sheets

PLUG CONNECTOR FOR HIGH-VOLTAGE COAXIAL CABLES

The invention relates to a plug connector for high-voltage coaxial cables, wherein the cable comprises an inner conductor, an inner insulation enclosing the inner conductor, a metallic screen netting enclosing the inner insulation and an insulating, outer sheath enclosing the screen netting, and wherein the plug connector comprises a plug-in contact element connected to the inner conductor, a metal sleeve connected to the screen netting and an insulating housing connecting the contact element to the metal sleeve.

Plug connectors of this kind are used in, for example, electrostatic high-voltage generators where voltages in the range of approximately 10 kV occur.

To ensure that these plug connectors will function, it is of prime importance that leakage currents and/or discharge gaps be strictly avoided inside them. To achieve this, the known plug connectors are filled out with electrically insulating casting resin which provides an absolutely reliable insulation between the conductive elements of the plug connector.

However, the use of casting resins in plug connectors has the serious disadvantage that the plug connectors are undetachably connected to the high-voltage coaxial cables by the casting resin cast therein and hence filling out all of the cavities and, in particular, undercuts and the like, which makes exchange of the plug connectors impossible. Therefore, at the assembly site the fitter is often unable to shorten cables to a desired length or defective plug connectors cannot be replaced on the spot by new plug connectors.

The object of the invention is to remedy this deficiency and to so design a generic plug connector that it is readily detachable from the cable again and, in the given circumstances, replaceable by a new plug connector.

The object is accomplished in accordance with the invention in that a sealing sleeve made of elastic material is pushed onto the inner insulation of the cable and the contact element penetrates into the conductor such that the inner insulation arranges itself sealingly against the inner surface of the sealing sleeve, and in that the sealing sleeve undergoes such deformation owing to the connection of the insulating housing to the metal sleeve that it arranges itself sealingly with its outer surface against the inner surface of the insulating housing.

Figure 1:
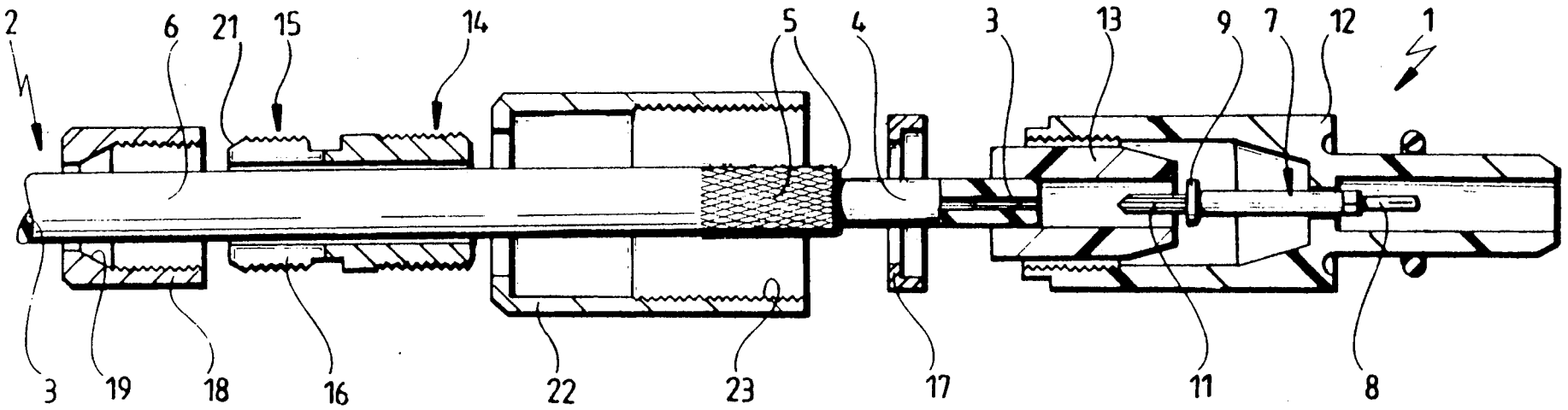
Figure 2:
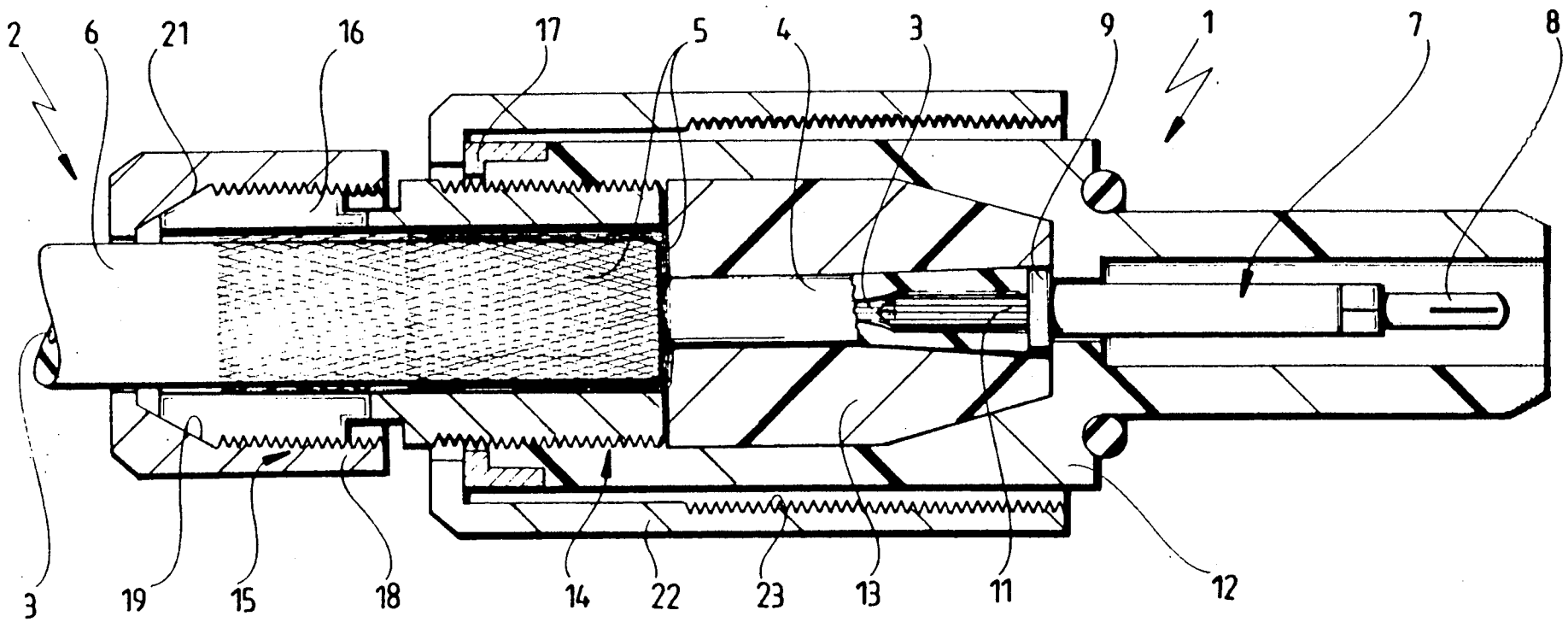

The following description of a preferred embodiment serves in conjunction with the appended drawings to explain the invention in further detail. The drawings show:

FIG. 1 a plug connector for a high-voltage coaxial cable in the disassembled state; and FIG. 2 the plug connector of FIG. 1 in the assembled state.

In the embodiment illustrated in the drawings, a plug connector 1 is connected to a conventional high-voltage coaxial cable 2.

The high-voltage coaxial cable 2 consists of an inner conductor 3 in the form of a stranded conductor made of thin metal wire or electrically conductive synthetic fibers. The inner conductor 3 is enclosed by an inner insulation 4 made of rubber or plastic. The inner insulation 4, in turn, is enclosed by a conventional metallic screen netting 5 which is usually connected to earth potential when the cable 2 is in use. An electrically insulating outer sheath 6 made of rubber or plastic is arranged around the screen netting 5. In the drawings, the screen netting 5 originally enclosing the inner insulation 4 is turned back and over the outer sheath 6, the outer sheath 6 being removed in the region of the exposed inner insulation 4 in FIGS. 1 and 2.

In the embodiment illustrated in FIGS. 1 and 2, the inner conductor 3 is directly enclosed by the inner insulation 4. In other embodiments, the inner conductor may be enclosed by an additional, intermediate insulation which, in turn, is then surrounded by the inner insulation 4.

In the illustrated embodiment, the actual plug connector 1 comprises a contact element 7 in the form of a plug which is electrically conductively connected to the inner conductor 3. The plug terminates at its front, free end in a conventional, preferably slotted plug pin 8. At the opposite end there is a connection pin 11 which preferably has axial or peripheral grooves or is externally threaded. Interposed between the ends is a disc-shaped collar 9 having an outer diameter corresponding to the outer diameter of the inner insulation 4. The connection pin 11 is introduced into the inner insulation 4 so as to penetrate into the inner conductor 3 and establish an electrically conductive connection with it.

As illustrated, the plug-in contact element 7 is combined with an insulating housing 12 which extends, on the one hand, beyond the plug pin 8 and, on the other hand, beyond part of the screen netting 5 lying on the outer sheath 6. When assembling the plug connector 1, the insulating housing 12 is pushed on (from the right in FIGS. 1 and 2).

In the illustrated embodiment, the plug-in contact element 7 is designed as a "plug" which fits into a complementary "socket" which is preferably fixedly arranged on a high-voltage device. The contact element 7 designed as a plug pin as shown in FIGS. 1 and 2 could, however, be designed as a socket which fits over a plug pin which is preferably fixedly arranged on the high-voltage device.

In the region of the connection pin 11, a sealing sleeve 13 made of elastic, electrically insulating material, for example, rubber or plastic is pushed onto the inner insulation 4 of the cable 2. When the connection pin 11 is inserted into the inner conductor 3 of the cable, the inner conductor 3 expands accordingly and with it the inner insulation 4 and so the inner insulation 4 arranges itself sealingly against the inner surface of the sealing sleeve 13. This ensures reliable electrical insulation of the connection pin 11 and the contact element 7 with respect to the contact ring 17 and the screen netting 5.

A metal sleeve 16 with two externally threaded regions 14, 15 is pushed onto the turned-over screen netting 5 of the cable 2 and thereby electrically conductively connected to the screen netting 5. The end of the insulating housing 12 remote from the plug pin is screwed with a corresponding internal thread onto the externally threaded region 14 of the metal sleeve 16. The insulating housing 12 carries at this end a metallic contact ring 17, the cross-sectional shape of which is apparent from FIGS. 1 and 2. This inner ring likewise comprises on its angled region an internal thread with which it is screwed onto the externally threaded region 14. In this way, the contact ring 17 is also electrically conductively connected to the screen netting 5.

The metal sleeve 16 has several axially parallel slots in the externally threaded region 15. A hat-shaped pull-relief nut 18 is screwed onto this threaded region 15 and cooperates with a conical inner region 19 with an end area 21 of corresponding conical design on the metal sleeve 16 in such a way that when the pull-relief nut 18 is screwed on, the metal sleeve 16 slotted in the externally threaded region 15 is compressed and hence firmly pressed onto the screen netting 5.

Finally, there is provided in the region of the insulating housing 12 a freely rotatable coupling sleeve 22 which enters with its one end (from the left in FIGS. 1 and 2) into electrical contact with the contact ring 17 and has an internal thread 23 on its opposite end. With this internal thread, the coupling sleeve 22 is screwed onto a corresponding, externally threaded socket which surrounds the previously mentioned socket (not illustrated) which is fixedly arranged on the high-voltage device. As illustrated, the end of the sealing sleeve 13 facing the contact element 7 is of conical design and penetrates a corresponding conical region of the insulating housing 12. When the insulating housing 12 is screwed onto the externally threaded region 14 of the metal sleeve 16, the sealing sleeve 13 undergoes corresponding deformation and arranges itself sealingly with its outer surface against the inner surface of the insulating housing 12, in particular, in the previously mentioned conical region. This sealing also provides perfect electrical insulation on the outside of the sealing sleeve 13, which reliably prevents leakage currents or electric discharge gaps.

The sealing sleeve 13 which seals and insulates in the fashion of a "stuffing box" owing to the pressure acting on it on all sides and the resulting deformation of the sleeve 13 replaces the casting resin commonly used in plug connectors of the kind in question. Therefore, the plug connector 1 is detachable from the cable 2 and connectable to it again or replaceable by a new plug connector at any time. To do so, the screw connections between the metal sleeve 16 and, on the one hand, the pull-relief nut 18 and, on the other hand, the insulating housing 12 merely have to be released, and after the insulating housing 12 has been pulled off the cable, the contact element 7 can be easily pulled out of the inner conductor 3 and the sealing sleeve 13 subsequently removed.

What is claimed is:

1. A plug connector for a high-voltage coaxial cable (2) comprising an inner conductor (3) consisting of several individual wires, an inner insulation (4) enclosing the inner conductor (3), a screen netting (5) enclosing the inner insulation (4) and an outer sheath (6) of insulating material enclosing the screen netting (5), said plug connector having:

(a) an insulating housing (12) in which a contact element (7) is centrally mounted, a connecting pin (11) of which is in electrical contact with the inner conductor (3) of the coaxial cable (2);

(b) a metal sleeve (16) being slidable onto the outer sheath (6) of coaxial cable (2) from which screen netting (5) was removed, this sheath being in electrical contact with screen netting (5) and with a coupling sleeve (22) which is coaxially arranged at contact element (7) and being in mechanical contact with the insulating housing (12); characterized by the following features:

(c) a sealing sleeve (13) is mounted within insulating housing (12) on the end of coaxial cable (2) from which outer sheath (6) and screen netting (5) have been removed;

(d) an inner insulation (4) of coaxial cable (2) is arranged at the inner wall of sealing sleeve (13) which inner insulation is widened by pushing the connection pin (11) of contact element (7) into the inner conductor (3) of coaxial cable (2), so that this inner insulation forms a sealing contact with the inner wall of the sealing sleeve (13);

(e) the outer wall of the sealing sleeve (13) being deformed by the pressing contact between the insulating housing (12) and the threaded region (14) to bring the outer wall of sealing sleeve (13) into sealing contact with the insulating housing (12).

* * * * *